US006502737B2

(12) United States Patent
Akiba

(10) Patent No.: US 6,502,737 B2
(45) Date of Patent: Jan. 7, 2003

(54) MAGAZINE FOR NAIL GUN

(75) Inventor: Yoshitaka Akiba, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/987,998

(22) Filed: Nov. 16, 2001

(65) Prior Publication Data

US 2002/0060233 A1 May 23, 2002

(30) Foreign Application Priority Data

Nov. 17, 2000 (JP) ..... 2000-350717

(51) Int. Cl.[7] ..... B25C 1/00
(52) U.S. Cl. ..... 227/109; 227/119; 227/120
(58) Field of Search ..... 227/8, 109, 119, 227/120, 136

(56) References Cited

U.S. PATENT DOCUMENTS 3,742,577 A * 7/1973 Buttriss ..... 227/112
3,797,723 A * 3/1974 Perkins et al. ..... 227/109
4,389,012 A * 6/1983 Grikis et al. ..... 221/198
4,688,710 A * 8/1987 Massari et al. ..... 227/109
4,784,306 A * 11/1988 Baum ..... 227/113
5,579,975 A * 12/1996 Moorman ..... 227/119
5,816,469 A * 10/1998 Ohuchi ..... 227/119
5,934,539 A * 8/1999 Lee ..... 227/109
6,036,072 A * 3/2000 Lee ..... 227/120
6,173,877 B1 * 1/2001 Wingert ..... 227/109
6,199,739 B1 * 3/2001 Mukoyama et al. ..... 227/120

* cited by examiner

*Primary Examiner*—Scott A. Smith
*Assistant Examiner*—Nathaniel C Chukwurah
(74) *Attorney, Agent, or Firm*—Sughrue Mion, PLLC

(57) ABSTRACT

A magazine for use with a nail gun includes a magazine body, a feeder, a nail gate, a wire, and a spring. The feeder presses nails supported in the magazine body to feed the loaded nails toward a nose-side end of the magazine body. The nail gate slidably disposed at a nail loading opening of the magazine body, and selectively allows insertion of long or short nails into the magazine body depending on whether it is slid into an upper or lower position. The wire and spring prevent sliding movement of the nail gate while nails are supported in the magazine body.

12 Claims, 6 Drawing Sheets

MAGAZINE FOR NAIL GUN

BACKGROUND OF THE INVENTION

1. Field of the Invention

The present invention relates to a magazine for supplying connected nails, which are connected in a plane-shaped condition, to a nail gun capable of driving two or more different-length nails.

2. Description of the Related Art

FIG. 1 shows a nail gun 101 that includes a drive portion 102, a nose 103, and a magazine body 104. Although not shown in the drawings, the drive portion 102 includes a cylinder, a piston, and other components for generating a force for driving nails into a work piece. The nose 103 is for guiding nails 108 that are driven by the drive portion 102 toward the work piece. The magazine body 104 stores a plurality of nails 108 and includes a feeder 105. The feeder 105 feeds nails 108 one after the other to the nose 103.

As shown in FIG. 2, the nails 108 are supported by a connection band, such as tape, in a plane-shaped group of connected nails 107. Each nail includes a nail head 108*a* and a nail shaft 108*b*, the nail head 108*a* being larger than the nail shaft 108*b*.

The nail gun 101 of FIG. 1 can use two different-length nails 108A, 108B, shown in FIGS. 3 and 4, respectively. The appropriate nail length depends on the thickness of the work piece, such as a wooden board, to be fixed in place. For example, inexpensive short nails 108B are preferred when the work piece is thin, because a thin work piece can be fixed in place without a great deal of supporting force. On the other hand, longer nails 108A need to be used to provide sufficient supporting force when the work piece is thick.

Because different driving energy is required for different length nails, a pressure reducing value is provided to adjust to the proper air compression force required for driving the currently loaded nail type 108A, 108B into the current work piece.

As shown in FIGS. 3 and 4, the magazine body 104 is formed with upper and lower guide rails 106*a*, 106*b* that enable supply of the different-length nails 108A, 108B. The upper and lower guide rails 106*a*, 106*b* guide the nail head 108*a* of the nails 108A, 108B so that the lower nail tip of both the long and short nails 108A, 108B is disposed at the same predetermined level.

However, the length of nails that are presently loaded in the magazine body 104 cannot be confirmed from outside of the magazine body 104. Therefore, it is difficult for an operator to judge whether the length of the current nails 108 is a proper match for the work piece to be fixed in place. As a result, the operator may operate the nail gun 101 to drive a nail with an improper length into the work piece.

Also, because it is impossible for the operator to confirm the length of the currently housed nails, the operator might erroneously load short nails 108B while long nails 108A are currently in the magazine body 104, or load long nails 108A while short-nails 108B are currently in the magazine body 104. This would result in two different length nails being housed in the magazine body 104 at the same time. When the nail gun 101 is operated repeatedly in this condition, then nails with different lengths may be driven immediately one after the other before the pressure reducing valve can change the drive force. As a result, a long nail 108A may be only partially driven into the work piece because the drive force is insufficient. On the other hand, a short nail 108B may be driven too deeply into the work piece, thereby forming an indentation in the work piece around the nail, because the driving force was excessive. Both of these conditions lower the supporting force for fixing the work piece in place. Also, the load on the nail gun 101 increases, thereby shortening the life of the nail gun 101.

SUMMARY OF THE INVENTION

It is an objective of the present invention to overcome the above-described problems and to provide a magazine that prevents different length nails from being erroneously mounted into the magazine body at the same time and that enables an operator to confirm the length of the nails currently housed in the magazine body.

To achieve the above-described objectives, a magazine according to the present invention includes a magazine body for supporting nails; a feeder for pressing nails supported in the magazine body to feed the nails toward a nose-side end of the magazine body; a nail gate movably disposed at a nail loading opening of the magazine body, and selectively allowing insertion long and short nails into the magazine body depending on position of the nail gate; and a nail gate movement prevention means that prevents movement of the nail gate while nails are supported in the magazine body.

It is describable that the movement prevention means include a wire and a spring. The spring presses the wire into engagement with the nail gate while nails are supported in the magazine body. The feeder presses the wire away from, and out of engagement with, the nail gate while no nails are supported in the magazine body.

It is desirable that the nail gate be colored differently from the color of magazine body.

It is desirable that the nail gate be provided with a recognition mark and the magazine body be provided with a plurality of nail length indications. The position of the nail gate aligns the recognition mark with a nail length indication that indicates length of nails presently insertable into the magazine body.

It is desirable that the magazine body include nail head supporting passages for supporting heads of nails loaded into the magazine body. The nail pressing portion of the feeder presses against a shaft portion of nails at a position below the nail head supporting passages so that only nails mounted with heads in nail head supporting passages proper for length of the mounted nail are pressed.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, a magazine 20 according to an embodiment of the present invention will be described. According to the embodiment, the magazine 20 is used with a nail gun 1.

Figure 5:
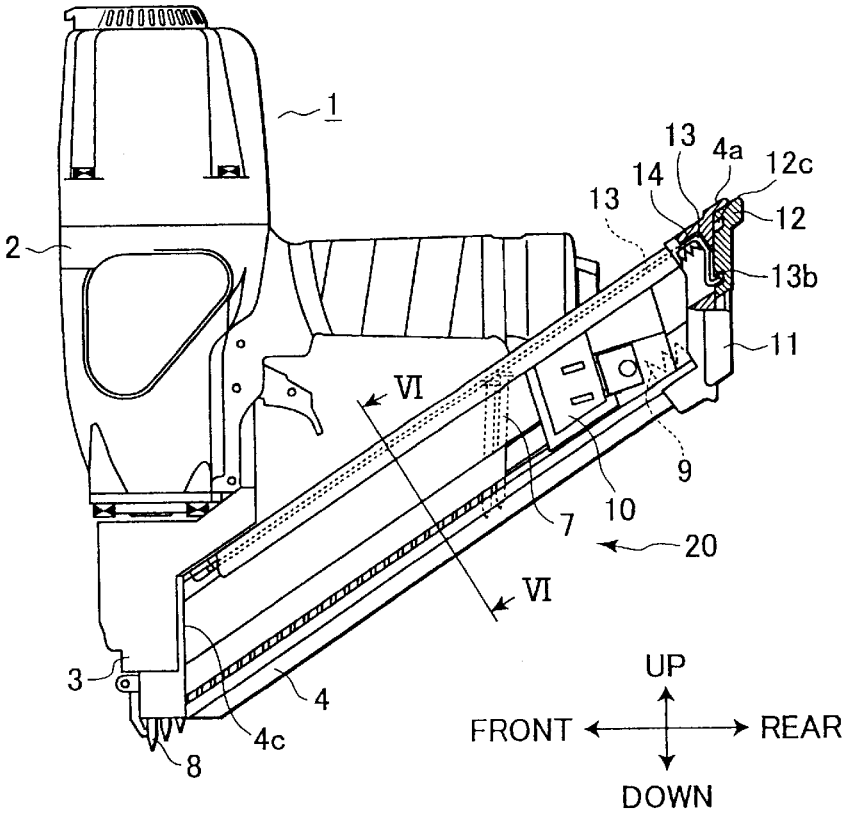
FIG. 5 is a side view showing a nail gun according to an embodiment of the present invention.

As shown in FIG. 5, the nail gun 1 includes a drive portion 2 and a nose 3. Although not shown in the drawings, the drive portion 2 includes a cylinder, a piston, and other components for generating a force for driving nails into a work piece. The nose 3 is for guiding nails 8 that are driven by the drive portion 2. The nail gun 1 is capable of driving either long nails 8A or short nails 8B, which have different lengths as shown in FIGS. 6 and 7.

The magazine 20 includes a magazine body 4, a feeder 10, a nail gate 12, a wire 13, and springs 9 and 14.

Figure 8:
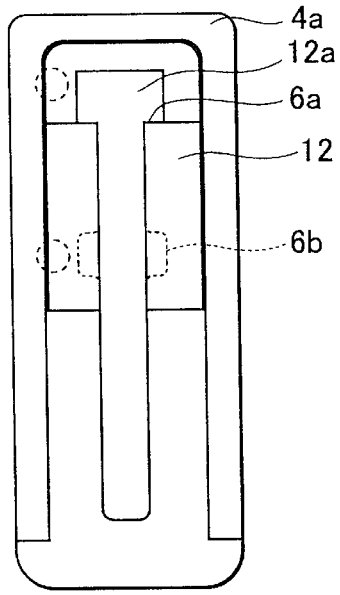
FIG. 8 is a rear view showing a rear portion of the magazine body with a nail gate in an upper position.
Figure 9:
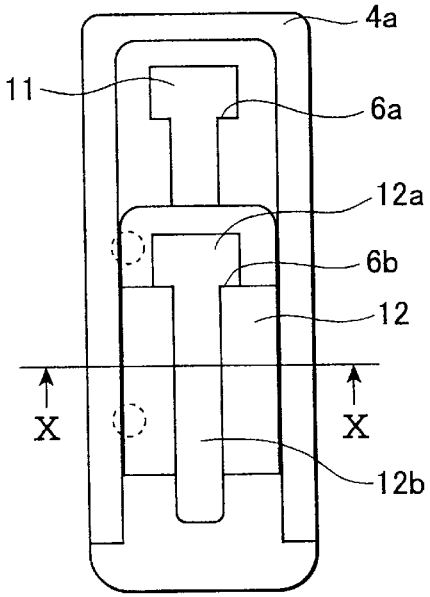
FIG. 9 is a rear view showing the rear portion of FIG. 8 with a nail gate in a lower position.
Figure 10:
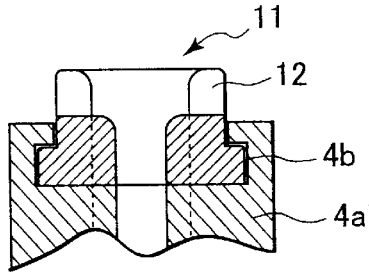
FIG. 10 is a cross-sectional view taken along line X—X of FIG. 9.

The magazine body 4 includes a front end 4*c* and a rear portion 4*a*. The front end 4*c* is adapted for attaching to the nose 3 of the nail gun 1. The rear portion 4*a* shown in FIGS. 8 and 9 is located at the opposite lengthwise end of the magazine body 4 than the front end 4*c*. As shown in FIG. 10, the rear portion 4*a* of the magazine body 4 is formed with a nail loading opening 11 and a guide groove 4*b*. Nails are loaded into the magazine body 4 through the nail loading opening 11. The guide groove 4*b* supports the nail gate 12 movable between an upper position shown in FIG. 8 and a lower position shown in FIG. 9.

Figure 1:
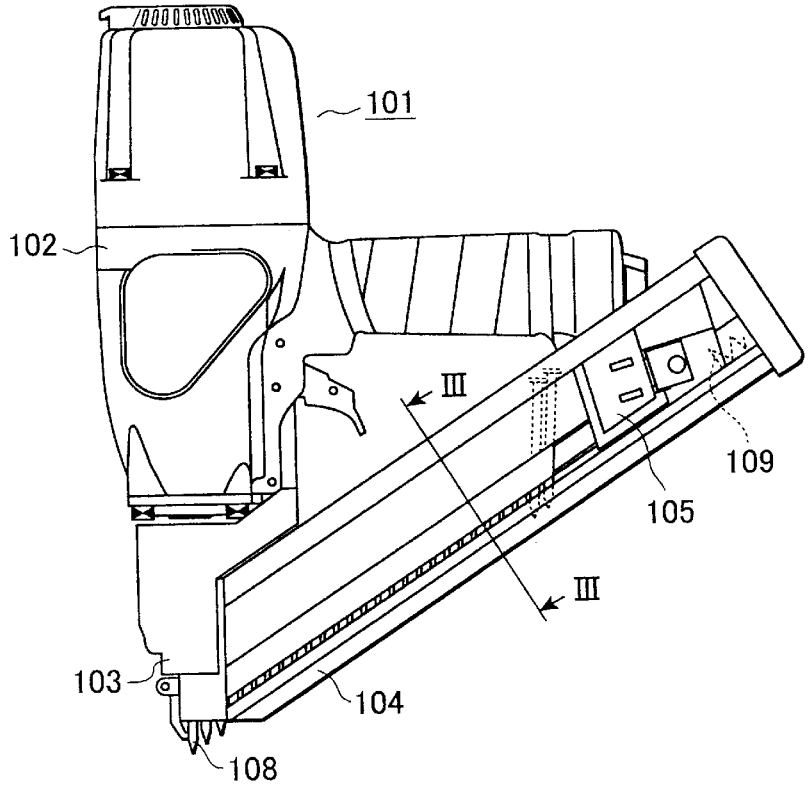
FIG. 1 is a side view showing a conventional nail gun.
Figure 2:
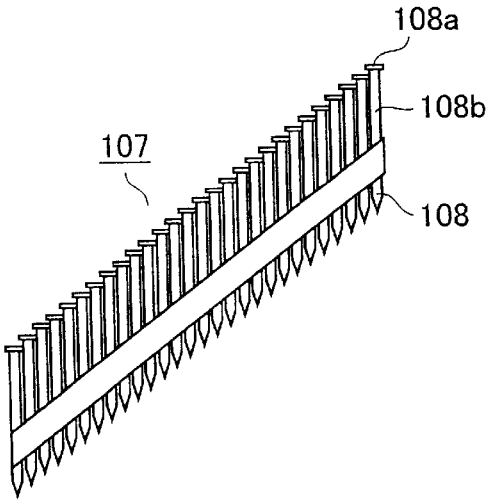
FIG. 2 is a side view showing a set of connected nails that are loaded in the nail gun of FIG. 1.
Figure 3:
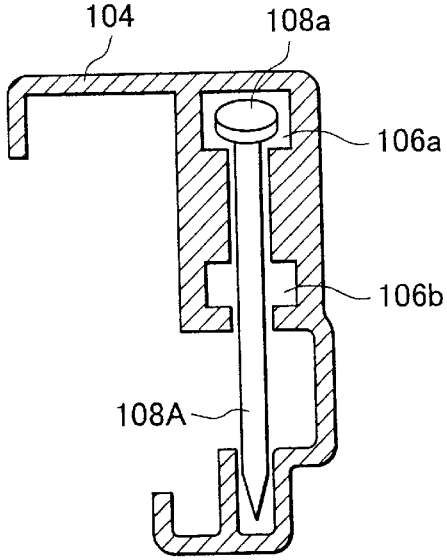
FIG. 3 is a cross-sectional view taken along line III—III of FIG. 1 showing a long nail loaded into a magazine of the nail gun of FIG. 1.
Figure 4:
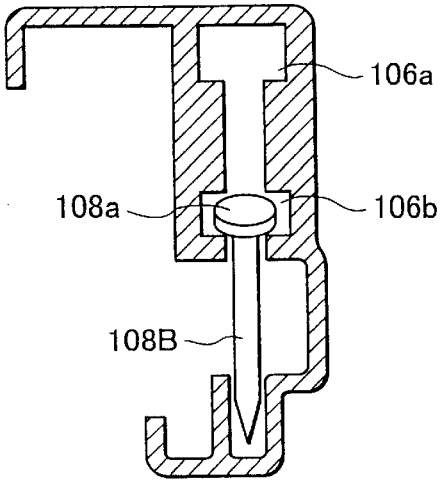
FIG. 4 is a cross-sectional view showing a short nail loaded into the magazine of FIG. 3.
Figure 6:
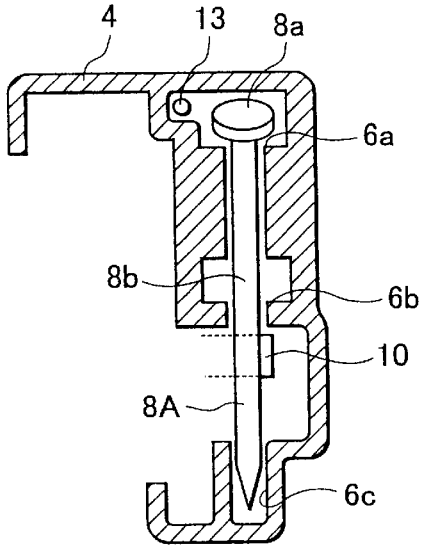
FIG. 6 is a cross-sectional view taken along line VI—VI of FIG. 5 showing a long nail being guided by an upper guide rail formed in a magazine body of a magazine used with the nail gun of FIG. 5.
Figure 7:
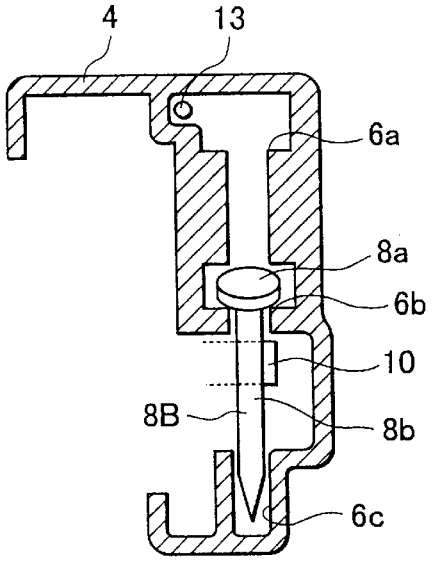
FIG. 7 is a cross-sectional view showing a short nail being guided by a lower guide rail of FIG. 6.

As shown in FIGS. 6 and 7, the magazine body 4 further includes a nail shaft passage 6*c* and upper and lower guide rails 6*a*, 6*b* that extend between the nail loading opening 11 and the front end 4*c*. The nail shaft passage 6*c* supports nails 8A, 8B so that nail shafts 8*b* are aligned in a shaft direction, which is the vertical direction when the magazine 20 is viewed as in FIG. 5. The upper and lower guide rails 6*a*, 6*b* are separated by a distance in the shaft direction so as to support the nail tip of the two different length nails 8A, 8B at the same level.

The feeder 10 is provided within the magazine body 4 and is urged by the spring 9 toward the front end 4*c* of the magazine body 4. As a result, the feeder 10 presses, under urging force from the spring 9, against the lower part of the shaft portion 8*b* of the nail 8 that is closest to the nail loading opening 11, and presses the connected nails 7 toward the front end 4*c* of the magazine body 4. As shown in dotted line in FIGS. 6 and 7, a nail pressing portion of the feeder 10 is positioned below the lower guide rail 6*b*, or said differently, is position to the side of the lower guide rail 6*b* that is the opposite side from the upper guide rail 6*a* with respect to the shaft direction. As a result, the pressing portion of the feeder 10 presses against the lower portion of the shaft of long nails 8A, but presses the upper portion of the shaft of short nails 8B. As will be explained later with reference to FIG. 19, the pressing portion of the feeder 10 will not press against short nails 8B that are supported in the upper rail 6*a*.

Figure 11:
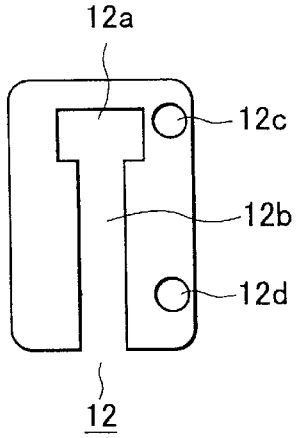
FIG. 11 is a front view showing the nail gate of FIGS. 8 and 9.
Figure 12:
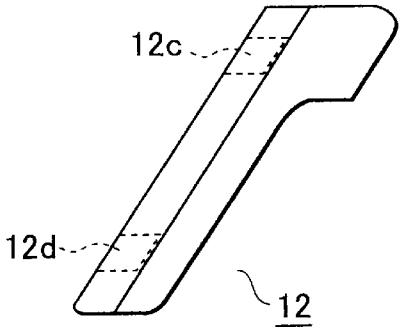
FIG. 12 is a side view showing the nail gate of FIG. 11.
Figure 13:
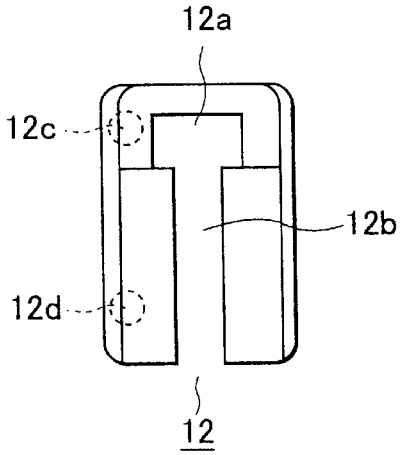
FIG. 13 is a rear view showing the nail gate of FIG. 11.

The nail gate 12 has a substantially inverted-U shape as viewed in FIG. 11 and FIG. 13. As shown in FIGS. 11 to 13, the nail gate 12 includes a nail head passage 12*a*, a nail shaft passage 12*b*, and upper and lower holding grooves 12*c*, 12*d*. When a nail 8A, 8B is loaded into the nail loading opening 11, the nail head 8*a* passes through the nail head passage 12*a* before entering the upper or lower guide rail 6*a*, 6*b* and the nail shaft 8b passes through the nail shaft passage 12*b* before entering the nail shaft passage 6*c*. The nail shaft passage 12*b* has a narrower width than the nail head passage 12*a* so that the nail head 8*a* of nails can not pass through the nail shaft passage 12*b*.

When the nail gate 12 is in the upper position shown in FIG. 8, then the nail head passage 12*a* is located at the position of the upper rail 6*a*. When the nail gate 12 is in the lower position shown in FIG. 9, then the nail head passage 12*a* is located at the position of the lower rail 6*b*.

As shown in broken line in FIG. 5, the wire 13 is provided within the magazine body 4 extending across substantially the entire magazine body 4 in the lengthwise direction of the magazine body 4. The wire 13 is supported movable in the lengthwise direction of the magazine body 4, and is normally urged by the spring 14 rearward toward the rear portion 4*a* of the magazine body 4. The wire 13 includes a front end 13*a* and a rear end 12*b*. The front end 13*a* engages with the feeder 10 when no nails 8 are supported in the magazine body 4. On the other hand, the rear end 12*b* is located adjacent to the rear portion 4*a* of the magazine body 4 and engages, under urging force from the spring 14, with the upper or lower holding grooves 12*c*, 12*d* of the nail gate 12 when nails 8 are supported in the magazine body 4.

Figure 14:
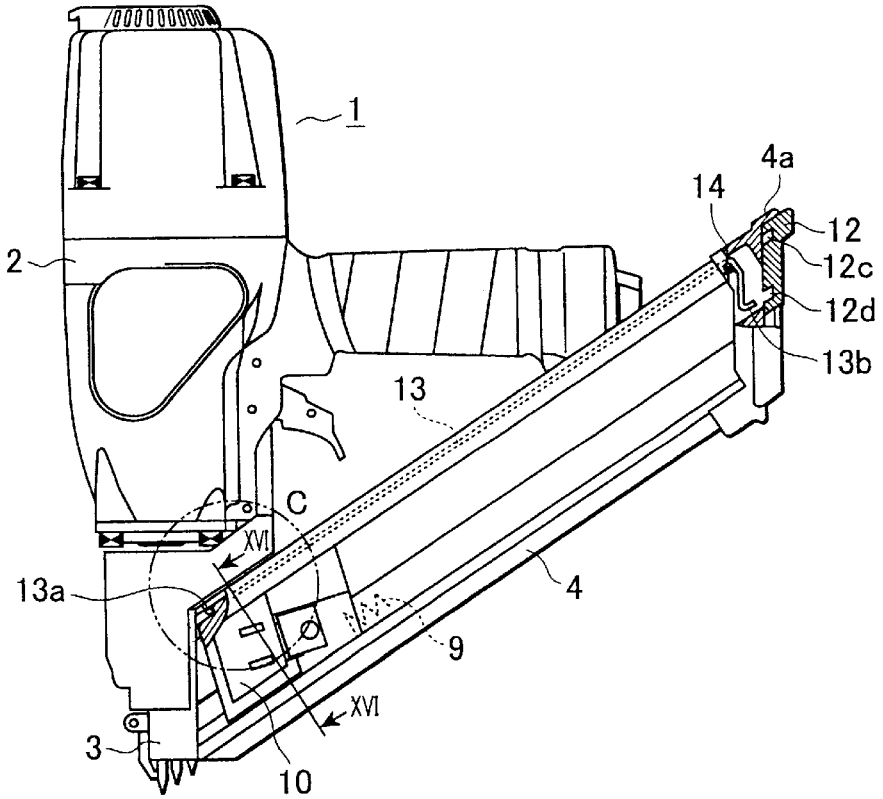
FIG. 14 is a side view showing the nail gun with no nails in the magazine body.
Figure 15:
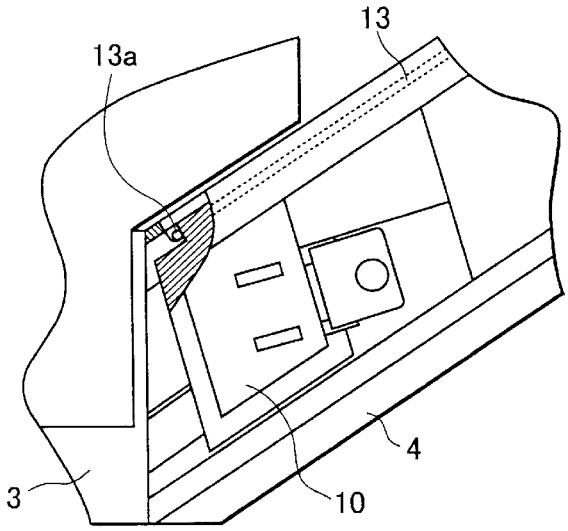
FIG. 15 is a magnified side view partially in cross section showing a feeder of the magazine pressing against a wire to enable movement of the nail gate.
Figure 16:
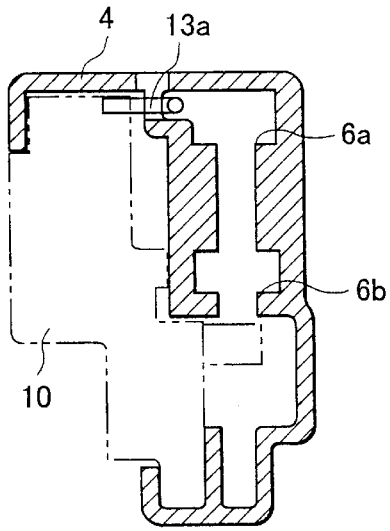
FIG. 16 is a cross-sectional view taken along line XVI—XVI of FIG. 14.
Figure 17:
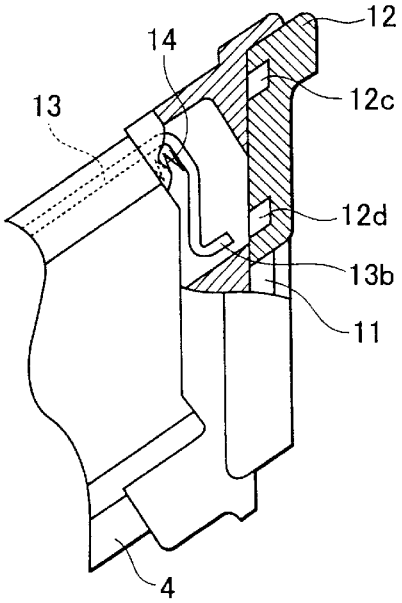
FIG. 17 is a magnified side view in partial cross section showing the wire disengaged from the nail gate while the nail gate is in the upper position.

Next, operation of the magazine 20 will be described. When there are no nails in the magazine body 4 as shown in FIG. 14, the feeder 10 is pressed by the spring 9 to the position as close as possible to the nose 3. As shown in FIGS. 15 and 16, the front end of the feeder 10 engages with the front end 13*a* of the wire 13 and moves the wire 13 toward the nose 3 against resistance from the spring 14. As shown in FIG. 17, the rear end 13*b* of the wire 13 moves away from the nail gate 12 and out of engagement with both of the grooves 12*c*, 12*d* in the nail gate 12. Because the wire 13 does not obstruct movement of the nail gate 12, the nail gate 12 can move upward and downward.

Figure 18:
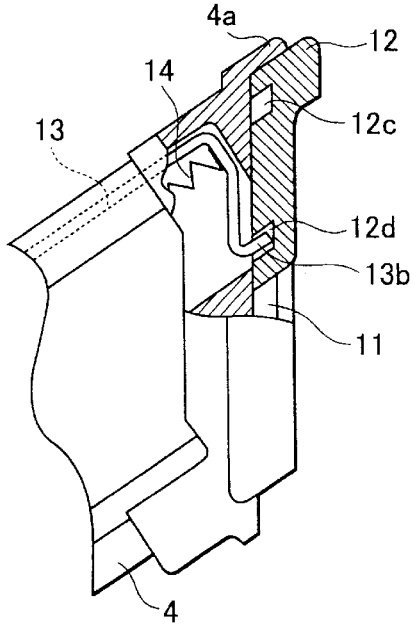
FIG. 18 is a magnified side view in partial cross section showing the wire engaged with the nail gate while the nail gate is in the upper position.
Figure 19:
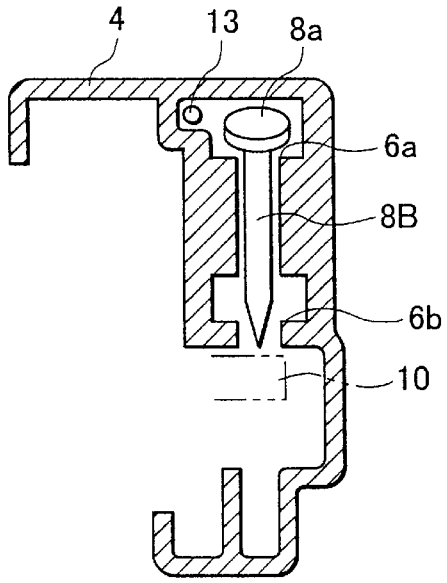
FIG. 19 is a cross-sectional view showing a short nail loaded in the wrong nail passage of the magazine.

To load long nails 8A into the magazine body 4, the operator slides the nail gate 12 into the upper position as shown in FIG. 17, loads long nails 8A into the nail loading opening 11, and retracts the feeder 10 to the rear of the rearmost long nail 8A. As a result, the feeder 10 presses the long nails 8A toward the nose 3 under the urging force of the spring 9. After nails 8A are loaded into the magazine body 4 in this manner, the feeder 10 no longer presses against the front end 13*a* of the wire 13. Therefore, as shown in FIG. 18 the urging force of the spring 14 presses the rear end 13*b* of the wire 13 into engagement with the lower holding groove 12*d*. This engagement prevents the nail gate 12 from moving downward. As a result, even if the operator mistakenly loads short nails 8B into the magazine body 4, as shown in FIG. 19 the nail tip of the short nails 8B will be supported higher than the pressing position of the feeder 10. Therefore, the feeder 10 will not supply the short nails 8B toward the nose 3. That is, even if short nails 8B are loaded into the magazine body 4 while long nails 8A are supported in the magazine body 4, there is no danger of the short nails being ejected by the nail gun 1, so the related problem of shortened life of the nail gun 1 can be prevented.

Figure 20:
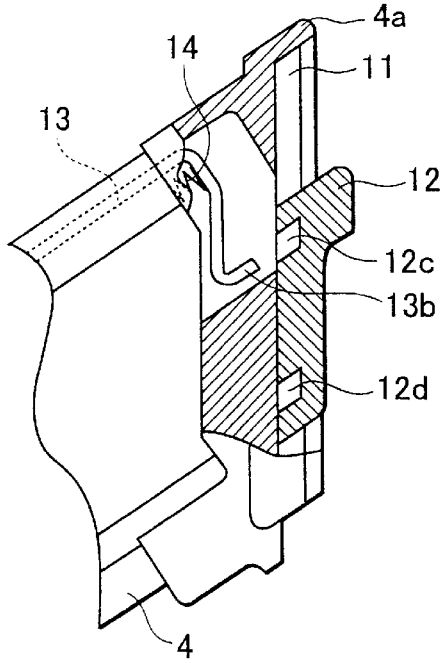
FIG. 20 is a magnified side view in partial cross section showing the wire disengaged from the nail gate while the nail gate is in the lower position.
Figure 21:
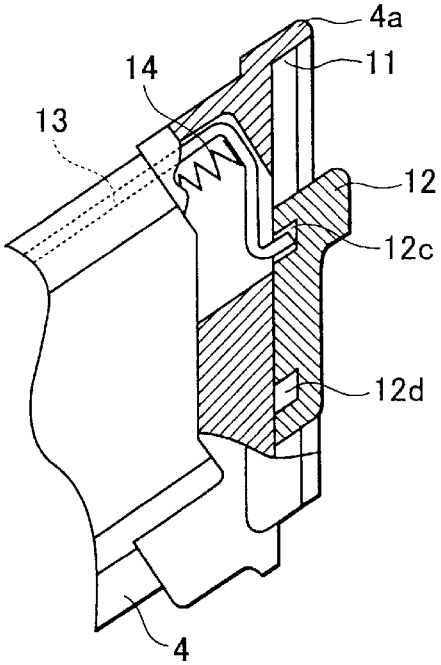
FIG. 21 is a magnified side view in partial cross section showing the wire engaged with the nail gate while the nail gate is in the lower position.

After long nails 8A are properly loaded into the nail gun 1 as shown in FIG. 5, the operator operates the nail gun 1 until all the nails 8 are spent from the magazine body 4. When no more nails are supported in the magazine body 4, then the magazine 20 will be back in the condition shown in FIG. 17, wherein the rear end 13*b* of the wire 13 is separated from the lower holding groove 12*d*. This returns the nail gate 12 into a movable condition, so that the nail gate 12 can be moved into the lower position shown in FIG. 20 and short nails 8B can be loaded into the magazine body 4. As the operator loads short nails 8B into the magazine body 4 and resets the feeder 10, as shown in FIG. 21 the wire 13 is pushed rearward by the spring 14 until the rear end 13*b* engages with the upper holding groove 12*c*, so that movement of nail gate 12 is obstructed. When the nail gate 12 is fixed in the lower position, the nail gate 12 prevents long nails 8A from being loaded into the magazine body 4.

After short nails 8B are loaded into the magazine body 4, movement of the nail gate 12 from the lower position will be obstructed as long as any short nails 8B remain in the magazine body 4. As a result, long nails 8A can not be loaded into the magazine body 4 at the same time as the short nails 8B. It should be noted that short nails 8B can be loaded into the magazine body 4 while long nails 8A are currently housed in the magazine body 4. However, this is not a problem because, as described above, in this case the feeder 10 will not press against the short nails 8B.

Figure 22:
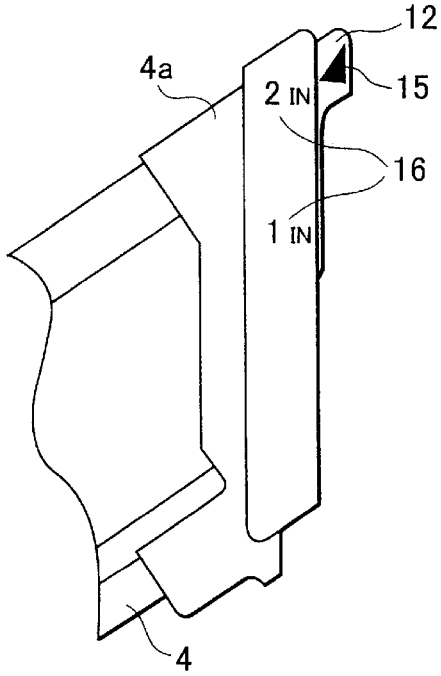
FIG. 22 is a magnified side view showing a recognition mark on the nail gate and nail length indications on the magazine body.

Next, a modification of the embodiment will be described while referring to FIG. 22. According to the modification, a confirmation mark 15 is provided on the nail gate 12 and nail length indications 16 are provided on the magazine body 4 at positions near the confirmation mark 15. With this configuration, when nails 8 remain in the magazine body 4, the operator will be able to know the length of the nails 8 based on the position of the nail gate 12. The operator can easily judge whether the nails 8 remaining in the magazine body 4 match the thickness of the work piece to be fixed in place with the nails 8, without directly viewing the nails 8 in the magazine body 4. The nail gate 12 is colored in a different color than the color of the magazine body 4 so that the position of the nail gate 12 can be easily recognized. As a result, the operator can easily determine the length of the nails 8 in the magazine body 4.

With the above-described configuration, only nails with the same length can be loaded into the magazine body. Also, because the length of nails in the magazine body can be easily confirmed, the operator can easily judge whether the nail length is appropriate for the present work piece.

As a result, the nail driving energy will always be appropriate for the nails in the manifold body, so long nails will not be only partially driven into the work piece because of a lack of driving energy and short nails will not be driven too far into the work piece because of an excess of driving energy. Related problems, such as reduction of supporting force by the nails and shortening of the nail gun's life, can be prevented.

What is claimed is:

1. A magazine for use with a nail gun, the magazine comprising:

a magazine body for supporting nails;

a feeder for pressing nails supported in the magazine body to feed the nails toward a nose-side end of the magazine body;

a nail gate movably disposed at a nail loading opening of the magazine body, and selectively allowing insertion long and short nails into the magazine body depending on position of the nail gate; and a nail gate movement prevention means that prevents movement of the nail gate while nails are supported in the magazine body.

2. A magazine as claimed in claim 1, wherein the movement prevention means includes a wire and a spring, the spring pressing the wire into engagement with the nail gate while nails are supported in the magazine body, the feeder pressing the wire away from, and out of engagement with, the nail gate while no nails are supported in the magazine body.

3. A magazine as claimed in claim 1, wherein the nail gate is colored differently from the color of magazine body.

4. A magazine as claimed in claim 1, wherein the nail gate is provided with a recognition mark and the magazine body is provided with a plurality of nail length indications so that position of the nail gate aligns the recognition mark with a nail length indication that indicates length of nails presently insertable into the magazine body.

5. A magazine as claimed in claim 1, wherein the nails are connected together in a plane-shaped condition.

6. A magazine as claimed in claim 1, wherein the magazine body includes nail head supporting passages for supporting heads of nails loaded into the magazine body, a nail pressing portion of the feeder being located to press against a shaft portion of nails at a position below the nail head supporting passages so that only nails mounted with heads in nail head supporting passages proper for length of the mounted nail are pressed.

7. A magazine for use with a nail gun that includes a drive portion and a nose portion, the drive portion generating a nail driving force, the nose portion being provided below the drive force portion with respect to direction of the drive force and guiding movement of the driven nail, the magazine comprising:

a magazine body including:

a nail loading opening through which nails are loaded into the magazine body, a nose-side end adapted for mounting on the nose portion; and a nail shaft passage and at least two nail head passages extending between the nail loading opening and the nose-side end, the nail shaft passage supporting loaded nails so that nail shafts of the loaded nails are aligned in a shaft direction, the at least two nail head passages being adapted for supporting nail heads of loaded nails, the at least two nail head passages being separated in the shaft direction to enable each to support a different length nail;

a feeder provided within the magazine body, the feeder pressing a nail shaft of a nail-loading-opening-side nail of the loaded nails to feed the loaded nails toward the nose-side end of the magazine body;

a nail gate disposed at the nail loading opening of the magazine body so as to be capable of reciprocal movement in the shaft direction, the nail gate including a nail shaft passage and a nail head passage, the nail shaft passage of the nail gate being aligned with the nail shaft passage of the magazine body, the nail head passage of the nail gate being aligned with one of the at least two nail head passages of the magazine body when the nail gate is at one position in the shaft direction and aligned with another of the at least two nail head passages of the magazine body when the nail gate is at another position in the shaft direction; and a movement prevention means for preventing movement of the nail gate while nails are supported in the nail shaft passage and any one of the at least two nail head passages in the magazine body.

8. A magazine as claimed in claim 7, wherein the movement prevention means includes a wire and a spring, the spring pressing the wire into engagement with the nail gate while any nails are supported in the magazine body, the feeder pressing the wire away from, and out of engagement with, the nail gate while no nails are supported in the magazine body.

9. A magazine as claimed in claim 7, wherein the nail gate is colored differently from the color of magazine body.

10. A magazine as claimed in claim 7, wherein the nail gate is provided with a recognition mark and the magazine body is provided with a plurality of nail length indications so that position of the nail gate in the shaft direction aligns the recognition mark with a nail length indication that indicates length of nails presently supported in the magazine body.

11. A magazine as claimed in claim 7, wherein the nails are connected together in a plane-shaped condition.

12. A magazine as claimed in claim 7, wherein a nail pressing portion of the feeder is located to press against a shaft portion of nails at a position below the nail head supporting passages so that only nails mounted with heads in nail head supporting passages proper for length of the mounted nail are pressed.

* * * * *